US011084632B2

(12) United States Patent
Combe et al.

(10) Patent No.: US 11,084,632 B2
(45) Date of Patent: Aug. 10, 2021

(54) RINGLESS METAL CANS AND METHOD

(71) Applicant: CROWN PACKAGING TECHNOLOGY, INC., Alsip, IL (US)

(72) Inventors: Florian Christian Gregory Combe, Oxfordshire (GB); Stephen John Osborn, Oxfordshire (GB); Lucy Michelle Winstanley, Gloucestershire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 36 days.

(21) Appl. No.: 15/555,709

(22) PCT Filed: Mar. 7, 2016

(86) PCT No.: PCT/GB2016/050606

§ 371 (c)(1),
(2) Date: Sep. 5, 2017

(87) PCT Pub. No.: WO2016/142677

PCT Pub. Date: Sep. 15, 2016

(65) Prior Publication Data

US 2018/0044074 A1 Feb. 15, 2018

(30) Foreign Application Priority Data

Mar. 11, 2015 (GB) ..... 1504128

(51) Int. Cl.
*B65D 43/02* (2006.01)
*B65D 43/04* (2006.01)
*B65D 6/34* (2006.01)

(52) U.S. Cl.
CPC ..... *B65D 43/021* (2013.01); *B65D 7/48* (2013.01); *B65D 43/022* (2013.01);
(Continued)

(58) Field of Classification Search
CPC ..... B65D 43/021; B65D 43/022; B65D 7/48; B21D 51/26; B21D 51/38; B21D 51/2615; B21D 51/2623; B21D 51/2676
(Continued)

(56) References Cited

U.S. PATENT DOCUMENTS 505,853 A * 10/1893 Schmitz ..... B65D 43/021 220/789
1,009,654 A * 11/1911 Ducker ..... 220/802
(Continued)

FOREIGN PATENT DOCUMENTS

CN 101107177 A 1/2008
DE 102010032327 A1 1/2012
(Continued)

OTHER PUBLICATIONS

Great Britain Application No. GB1504128.8: Combined Search and Examination Report under Sections 17 and 18(3) dated May 1, 2015, 8 pages.
(Continued)

*Primary Examiner* — Gideon R Weinerth
(74) *Attorney, Agent, or Firm* — BakerHostetler

(57) ABSTRACT

A can comprises a can body (10) and a lid (4). The can body is manufactured using only a single homogeneous piece of material and has an edge that defines a top opening into the can. The can body also has an inwardly directed bead (23), which extends around the body, is adjacent to the can body edge, and defines an inwardly facing sealing surface (24) of substantially constant transverse cross-sectional dimension along an axial extent. The lid defines an outwardly directed sealing surface which abuts the inwardly facing sealing surface presented by the inwardly directed bead in order to seal the lid to the can body. An alternative can body has an inwardly directed pinched or collapsed bead which defines
(Continued)

an upwardly facing sealing surface (34) for engagement with a downwardly facing sealing surface of a can lid. The alternative can body additionally has an inwardly directed bead (35) between the can body edge and the pinched or collapsed bead. An outer brim (42) of the lid is configured to be retained between the two beads of the alternative can body.

17 Claims, 6 Drawing Sheets

(52) U.S. Cl.
CPC ..... *B65D 2543/0062* (2013.01); *B65D 2543/0075* (2013.01); *B65D 2543/00092* (2013.01); *B65D 2543/00277* (2013.01); *B65D 2543/00351* (2013.01); *B65D 2543/00509* (2013.01); *B65D 2543/00518* (2013.01); *B65D 2543/00546* (2013.01); *B65D 2543/00685* (2013.01); *B65D 2543/00796* (2013.01); *B65D 2543/00898* (2013.01); *B65D 2543/00972* (2013.01)

(58) Field of Classification Search
USPC ..... 220/780, 656, 789, 87, 281, 265, 787
See application file for complete search history.

(56) References Cited

U.S. PATENT DOCUMENTS 1,381,704 A * 6/1921 Draper ..... B65D 43/021 220/787
1,667,084 A * 4/1928 Stern ..... B65D 43/021 220/787
1,765,478 A * 6/1930 Anderson ..... B65D 43/0293 220/274
1,919,574 A * 7/1933 Schmidt ..... B65D 43/0212 220/794
1,930,324 A * 10/1933 Stern ..... B65D 43/021 220/787
2,026,946 A * 1/1936 Le Comte ..... B65D 7/34 220/789
2,027,438 A * 1/1936 Heinrich ..... B65D 7/34 220/258.3
2,084,084 A * 6/1937 Greer ..... B65D 43/0216 220/798
2,092,118 A * 9/1937 Hodgson ..... B65D 43/022 220/801
2,107,437 A * 2/1938 Forsyth ..... B65D 51/18 220/789
2,142,743 A * 1/1939 Calleson ..... B65D 43/0212 220/309.2
2,332,553 A * 10/1943 Benedict ..... B65D 43/0212 220/792
2,382,378 A * 8/1945 Bloedorn ..... B65D 43/0233 220/310.1
2,467,392 A * 4/1949 Kinberg ..... B65D 43/0212 220/284
2,652,947 A * 9/1953 Henchert ..... B65D 43/021 220/787
2,775,362 A * 12/1956 Henchert ..... B65D 43/0216 220/798
3,142,409 A * 7/1964 Ross ..... B65D 43/022 220/281
3,211,323 A * 10/1965 Foster ..... B65D 43/0291 220/270
3,329,302 A * 7/1967 Kitchen ..... B65D 43/0222 220/284
3,347,408 A * 10/1967 Baker, Sr. ..... B65D 43/021 220/789
3,358,876 A * 12/1967 Joosten ..... B65D 7/36 220/614
3,420,397 A * 1/1969 Miller ..... B65D 21/0233 206/519
3,456,837 A * 7/1969 Medley ..... B65D 21/0219 220/284
3,696,963 A * 10/1972 Saunders ..... B65D 41/16 220/794
4,171,063 A * 10/1979 Cloutier ..... B44D 3/127 220/276
4,180,179 A * 12/1979 Hoenig ..... B65D 43/0206 220/783
4,458,825 A 7/1984 Holota
4,679,699 A * 7/1987 Malsbury ..... B65D 43/021 220/789
4,846,366 A * 7/1989 Satz ..... B42F 17/18 220/787
4,865,212 A * 9/1989 Bravo ..... B65D 1/46 220/657
4,881,656 A 11/1989 Chumley et al.
5,289,938 A * 3/1994 Sanchez ..... B65D 1/46 220/656
5,295,603 A * 3/1994 Schormair ..... B65D 43/021 220/284
5,307,949 A 5/1994 Von Holdt, Jr.
5,339,977 A * 8/1994 Schormair ..... B65D 21/022 220/284
8,671,730 B2 * 3/2014 Ytsma ..... B21D 51/2615 72/348
10,329,055 B2 * 6/2019 Combe ..... B65D 17/502
2009/0277908 A1 * 11/2009 Alvares ..... B65D 7/04 220/362
2018/0009579 A1 * 1/2018 Wada ..... B65D 43/22
2018/0044074 A1 * 2/2018 Combe ..... B65D 7/48

FOREIGN PATENT DOCUMENTS

EP 0125501 A1 11/1984
EP 1800770 A1 6/2007
FR 817603 A 9/1937
FR 2639561 A1 6/1990
GB 530069 A 12/1940
GB 844545 A 8/1960
JP 2004142756 A 5/2004
WO WO 96/07593 A1 3/1996
WO WO 2006/050592 A2 5/2006
WO WO 2014/027180 A1 2/2014

OTHER PUBLICATIONS

Great Britain Application No. GB1504128.8: Examination Report under Section 18(3) dated Sep. 7, 2015, 2 pages.
International Patent Application No. PCT/GB2016/050606: International Search Report and the Written Opinion dated May 13, 2016, 13 pages.
"Technical drawing of the Seesen can" retrieved from https://triviumpackaging.com/, dated Oct. 17, 2019, 2 Pages.
"Technical drawing of the lid ring of the Seesen can" dated Sep. 21, 2009, 4 Pages.

* cited by examiner

RINGLESS METAL CANS AND METHOD

CROSS-REFERENCE TO RELATED APPLICATIONS

This application is the National Stage of International Application No. PCT/GB2016/050606, filed Mar. 7, 2016, which claims the benefit of GB application number 1504128.8, filed Mar. 11, 2015, the disclosures of which are incorporated herein by reference in their entirety.

TECHNICAL FIELD

The present invention relates to ringless metal cans suitable for use with replaceable lids.

BACKGROUND

Conventional metal cans or containers for use with replaceable lids, in particular paint cans and the like, typically have a cylindrical body formed by rolling a flat metal sheet into a cylinder and forming a seam along the join, e.g. by welding. An end is seamed to a bottom opening of the can to provide a can bottom. In order to provide a means that allows a lid to be replaceably secured to a top opening of the can in such a way as to close the can and thereby prevent leaks, a ring is non-removably seamed around the top opening. The ring is typically made by stamping out a blank from a flat sheet and subsequently forming the blank to have an appropriate cross-sectional shape.

FIG. 1 is a perspective view of a conventional can 1 with can body 2 and which is provided with a ring 3 to locate and seal a lid 4 in place. FIG. 2 shows a detail of the can, taken as an axial cross-section. The ring 3 is secured to the upper, peripheral edge region of the can 1 by curling the ring 3 around the edge as shown in region A of the Figure. The ring 3 is further formed at its innermost region to provide a substantially circular, flat inwardly facing sealing surface 5. The cross-sectional shape of the ring 3 further defines an annular space or gap 6 that opens into the space above the can, between the inner and outer edges of the ring. The lid 4 is formed with a generally flat, circular panel 7 that is surrounded by a deep, U-shaped bead 8 that terminates at its peripheral edge with a curl 9. The bead 8 provides a circular, flat sealing surface 10 that faces outwardly to abut the sealing surface 5 presented by the ring 3. It will be appreciated from the Figures that a lever, such as a screwdriver, can be inserted into the gap 6 to enable the lid 4 to be prised from the top of the can 1.

Whilst the use of a ring provides for increased rigidity and provides excellent sealing properties, it does increase the overall metal required to manufacture a can and therefore adds to the manufacturing costs. It has therefore been recognised that a ringless can is desirable. U.S. Pat. No. 5,316,169 describes a ringless can in which beads are provided around the top opening in the can body to increase the rigidity of this region and provide a sealing surface for the lid. The lid has an annular sealing groove formed around its periphery, with the groove fitting over the upper edge of the can opening. A drawback of this design is that, whilst a lever can be inserted into a gap under the lid and a force applied between the underside of the groove and the outer surface of the can, such an action may damage the structure of the lid and or the can, thereby preventing the lid being reattached with a sufficiently good seal. Moreover, the design of U.S. Pat. No. 5,316,169 requires a completely new lid design and the can body cannot be used with conventional can lids, that is for use with lids designed for use with cans having a ring. Furthermore, the structure of the can body of U.S. Pat. No. 5,316,169 and of similar can body designs requires a relatively complex can body formation process involving multiple beads. It is generally accepted that the more a structure deviates from conventional structures, the greater the manufacturing costs will be (principally arising from increased capital expenditure to install new manufacturing equipment).

SUMMARY

According to a first aspect of the present invention there is provided a can comprising a can body, which comprises only a single homogeneous piece of material and has an edge defining a top opening into the body. The can body further comprises an inwardly directed bead pressed into and extending around the body adjacent to said edge, and defines an inwardly facing sealing surface. The can further comprises a lid that defines an outwardly directed sealing surface. This surface abuts the inwardly facing sealing surface presented by the bead in order to seal the lid to the can body.

In certain embodiments of the can, the edge defining the top opening into the body is a curled edge. The inwardly facing sealing surface of the inwardly directed bead may overlap at least partially with the curled edge in an axial direction.

In some embodiments, the inwardly facing sealing surface defined by the bead is of substantially constant transverse cross-sectional dimension along an axial extent.

In some further embodiments, the radially outermost region of the inwardly directed bead is collapsed in the axial direction to substantially close the bead to an area surrounding the can body, and the resulting bead has an axial cross-sectional shape that is substantially triangular. In particular, the cross-sectional shape is substantially that of an isosceles triangle, which has a centre line that extends radially and is substantially in axial alignment with the closed region of the bead.

In some still further embodiments, an upwardly facing surface or surfaces of the inwardly directed bead define, together with the edge defining the top opening into the body, an annular trough located radially inside the edge. The lid is configured to allow access to the trough by a lid removal tool.

In some embodiments, the inwardly directed bead has a radial depth ranging from 2 mm to 10 mm or, preferably, ranging from 2 mm to 5 mm. In other embodiments, the sealing surface of the inwardly directed bead has an axial extent of between 2 mm to 10 mm or, more preferably, of between 2 mm to 6 mm.

In some embodiments, the can body is metallic. In other embodiments, the can body and the lid are configured such that, when the lid is sealed to the can body, an upper surface of the lid is located above the edge of the can body. In still further embodiments, the can comprises an end secured to the can body to close a bottom opening of the can body.

In some embodiments, the lid comprises a substantially flat panel having a U-shaped bead defined around its periphery, with a radially outer surface of the U-shaped bead providing the outwardly directed sealing surface. The lid may further comprise a curled peripheral edge, with a lower surface of that curled edge abutting an upper surface of the inwardly directed bead.

According to a second aspect of the present invention there is provided a can body with a curled edge that defines a top opening into the can body. The can body further comprises an inwardly directed bead which is pressed into and extends around the body and which is substantially adjacent to the curled edge. The bead presents an inwardly facing sealing surface of substantially constant transverse cross-sectional dimension along an axial extent.

According to a third aspect of the present invention there is provided a method of processing a tubular can body. The method comprises the steps of: providing a tubular can body; pressing an inwardly directed bead, which extends around the can body, into the can body; and collapsing the bead around its periphery. Collapsing the bead substantially closes the bead to the area surrounding the can body, whilst providing an inwardly directed sealing surface that has a substantially constant transverse cross-sectional dimension along an axial extent.

The method may involve the steps of pressing and collapsing the inwardly directed bead, providing the bead with a sealing surface that overlaps, at least partially, with a curled edge of the can body in an axial direction.

The method may further involve that the step of collapsing comprises applying opposed compression tools to upper and lower surfaces of the inwardly directed bead, with the opposed surfaces of the compression tools being angled relative to the transverse direction, so as to compress the bead such that its adopts a cross-sectional shape that is substantially triangular.

According to a fourth aspect of the present invention there is provided a can body of a single homogeneous piece of material. The can body comprises an edge defining an upper opening into the body; an inwardly directed pinched or collapsed bead pressed into and extending around the can body adjacent to said edge, the pinched or collapsed bead defining a flange providing an upwardly facing sealing surface; and an inwardly directed bead extending around the body between the edge and the pinched or collapsed bead. The can body is configured such that a lid can be press or snap fitted into the upper opening and retained in sealing engagement between the two beads.

The pinched or collapsed bead may have an axial cross-sectional shape that is substantially a rhomboid.

The pinched or collapsed bead may be substantially closed to an area surrounding the can body.

The can body edge may be an outwardly curled edge. The can body may be of metal.

According to a fifth aspect of the present invention there is provided a can comprising a can body according to the fourth aspect above and a can lid. The can lid comprises a substantially flat centre panel from which a downwardly dependent cylindrical side wall extends; and an outer brim which extends from the side wall, the outer brim defining or supporting a downwardly facing sealing surface for engagement with said sealing surface of the can body, wherein a peripheral edge of the brim is configured to be retained between the two beads of the can body.

The edge of the brim may be a curled edge.

The lid may comprise a sealing compound provided on an underside of the brim to provide said downwardly facing sealing surface. The brim may define a downwardly opening channel between the curled edge and the side wall, said sealing compound being located in the downwardly opening channel.

The lid may fit inside the top opening of the can body such that an annular gap is present between the curled edge of the can body and said centre panel of the lid to allow insertion of a lever into the gap to remove the lid. The centre panel of the lid may have a radially directed lip around its periphery.

The can may comprise an end secured to the can body to close a bottom opening of the can body.

DETAILED DESCRIPTION

A conventional paint can with ring has been described above with reference to FIGS. 1 and 2. An improved ringless paint can will now be described with reference to FIGS. 3 to 10.

Figure 3:
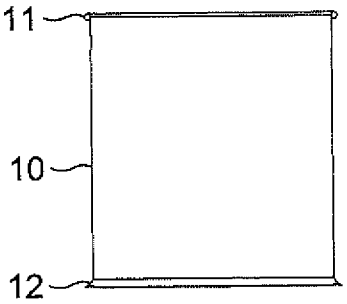
FIGS. 3 to 7 illustrate various stations used in the production of a novel ringless can body as well as various manufacturing states of the body.

The first stages of forming a cylindrical can body are conventional, requiring cutting of a rectangular flat sheet, rolling the sheet into a cylinder, and welding the abutting edges to form a seam. A curl is formed around the top edge of the can body in order to strengthen the edge whilst "hiding" the cut edge. An outwardly directed flange is formed around the bottom edge of the can body to allow subsequent attachment of bottom end. FIG. 3 illustrates a can body 10 formed in this manner, with a curl 11 formed around its top edge and a flange 12 directed outwardly around its bottom edge. A bottom end has not yet been attached to the can body such that the bottom remains open.

Figure 4:
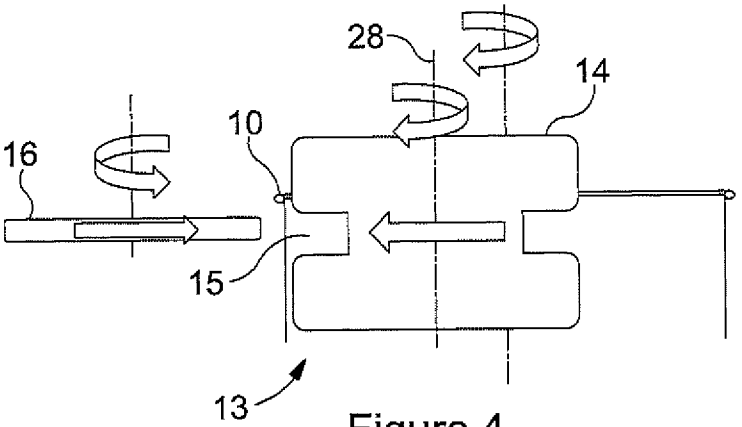
Figure 5:
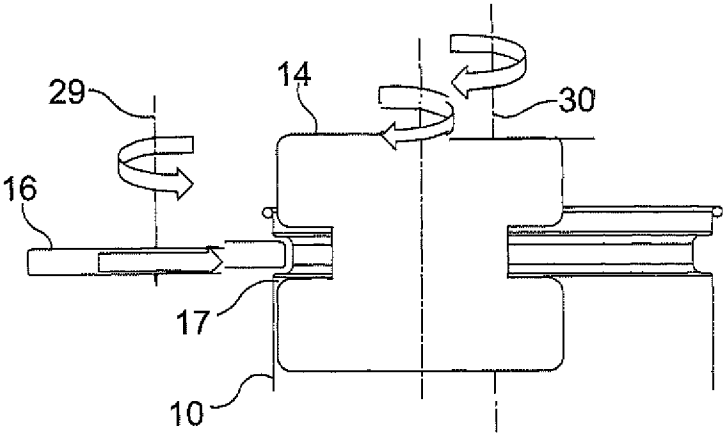

FIG. 4 illustrates tools of a deep-bead forming station 13 into which the can body 10 of FIG. 3 is introduced. This station 13 is configured to form an inwardly directed bead circumferentially around the can body 10, with a predetermined depth, height and shape. A first inner tool 14 is generally cylindrical and is rotatable about the axis 28 of its cylindrical shape. A groove 15 is provided around the circumference of the inner tool 14 and has a generally rectangular cross-sectional shape. A second outer tool 16 is generally cylindrical and is mounted for rotation about its axis to rotate in the opposite direction of outer tool 16. The tool 16, and its rotational mounting, can be moved radially with respect to the axis of the inner tool 14.

At the bead forming station 13, the inner tool 14 is inserted into the can body 10 through the top opening. Whilst the can body 10 remains stationary, both the outer tool 16 and the inner tool 14 mutually engage by moving radially in opposite directions. This causes a portion of the can body 10 to be pressed into the groove 15 around the inner tool 14. This is the position illustrated in FIG. 5. [Other arrangements to engage the inner 14 and outer tools 16 may also be contemplated.] The outer tool 16 is then rotated about its own axis 29. The inner tool 14 is counter-rotated about its own axis 28 (the inner tool 14 may be driven or may rotate freely). This operation causes the can body 10 to rotate about its own axis 30 such that a bead 17 is formed around the entire circumference of the can body 10.

Figure 6:
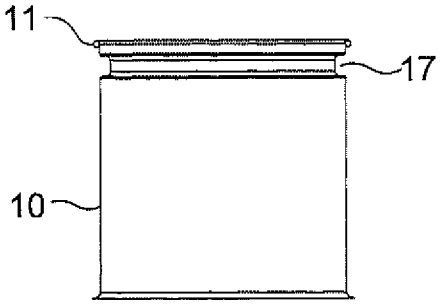
Figure 7:
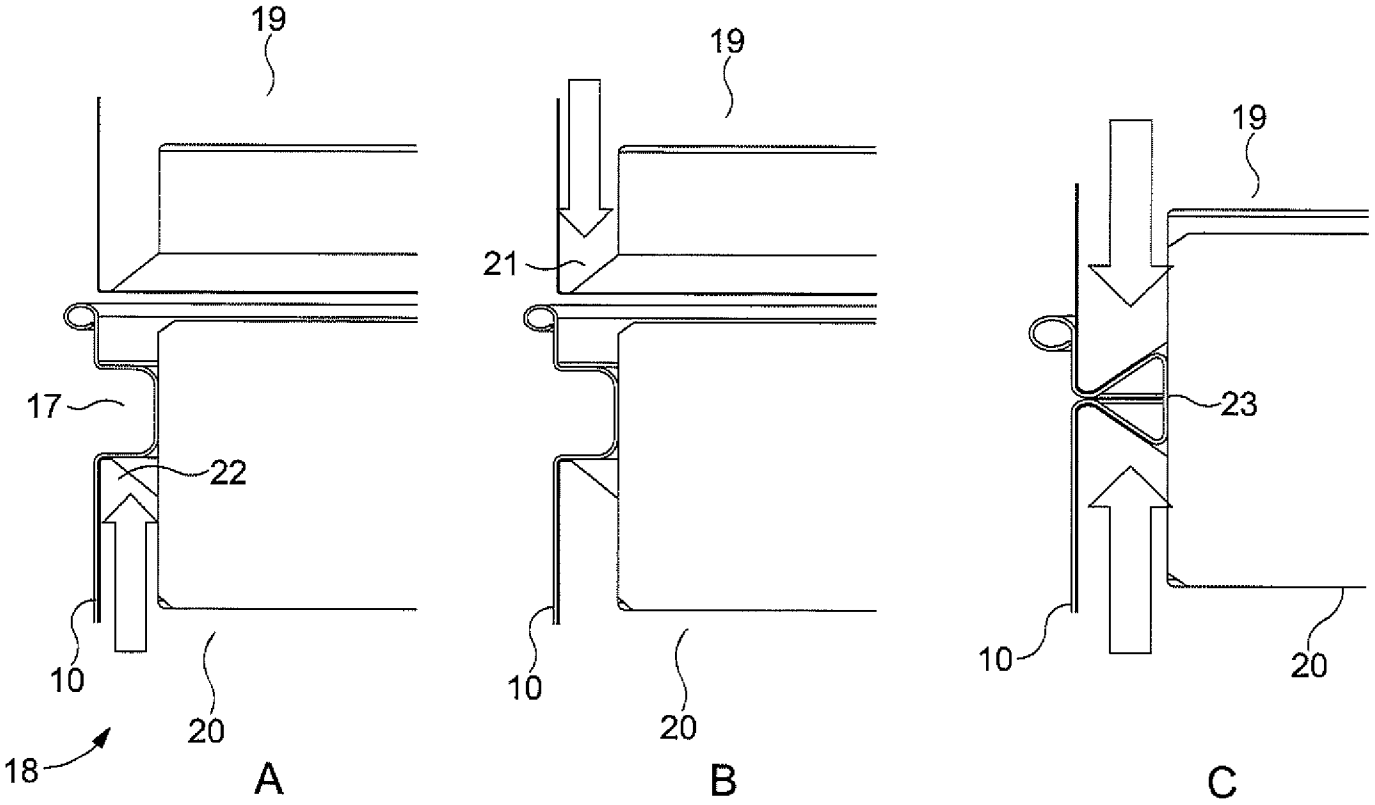

At least a rotation of just over 360 degrees is required to form the groove. However, forming the inwardly directed bead 17 normally requires between 3 to 20 revolutions of the can body 10 around its axis 30. Following this operation, the inner 14 and outer tools 16 are moved out of engagement with the can body 10. FIG. 6 illustrates the formed can body 10 following removal from the bead forming station 13.

The can body 10 is then moved to a bead re-sizing station 18, the operation of which is illustrated in FIGS. 7A, 7B and 7C. This station 18 makes use of an upper bead shaping tool 19 and a lower bead shaping tool 20. These tools 19, 20 have complimentary shaped angled features 21 and 22 formed on their opposed end regions. FIGS. 7A and 7B show the upper and lower bead shaping tools 19, 20 being introduced into the can body 10. The uppermost edge of the angled feature 22 of the lower tool 20 has been introduced into the can body 10 through the bottom opening and is just engaged with the lower, peripheral region of the bead 17, whilst the upper bead shaping tool 19 is about to enter the can body 10 through the top opening. FIG. 7C shows the upper and lower bead shaping tools 19, 20 being brought together around the bead 17, pressing the top and bottom surfaces of the bead 17, at their outer peripheral regions, together, i.e. effectively pinching the bead 17 together at its outer region to form a pinched bead 23. The upper and lower bead forming tools 19, 20 are then removed from the can body 10, and the body 10 is advanced to the next station in the production line, e.g. a station that attaches the bottom end to the can body 10.

Figure 8:
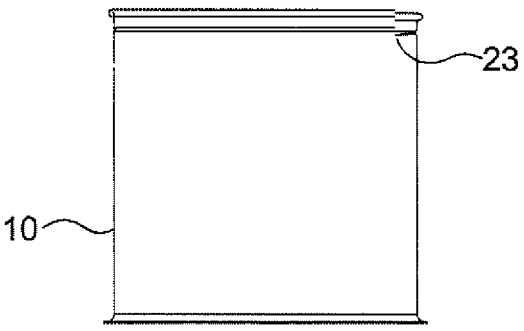
FIG. 8 illustrates a ringless can body.
Figure 9:
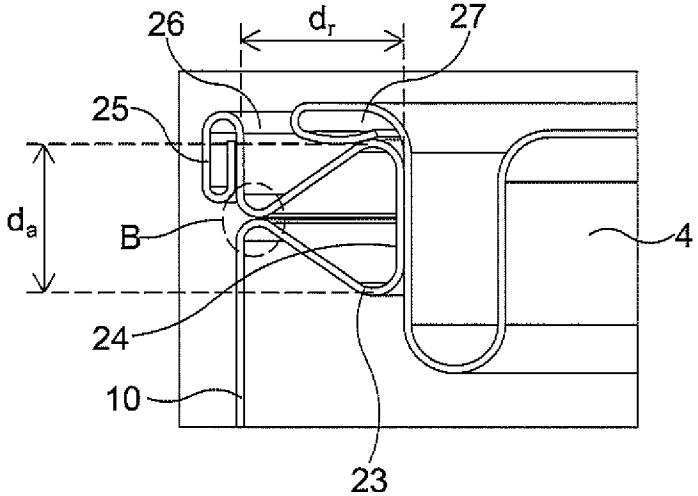
FIG. 9 illustrates a detail of a novel ringless can body with a lid attached.

FIG. 8 illustrates the completed can body 10 with pinched bead 23. FIG. 9 illustrates a cross-sectional detail of the formed can body 10, also illustrating a lid 4 in place. The pinched bead 23 is generally triangular in cross-section, with the outermost region B effectively closed by the bead shaping operation. This closure of the bead 23 is desirable to structurally reinforce the bead 23, thereby preventing a collapse under axial loading, and to prevent the subsequent ingress of product and dirt, etc., into the bead 23. The inwardly facing sealing surface 24 of the pinched bead 23 is flat in cross-section, and has a circular cross-section when viewed axially. In other words, the sealing surface 24 has a substantially constant transverse cross-sectional dimension along its axial extent. The radial depth $d_r$ of the bead 23 is preferably in the range of 2 mm to 10 mm, and more preferably in the range 2 mm to 5 mm. The closed outer area B of the bead 23 lies just beneath the curled edge 25 of the can body 10, i.e. immediately beneath that edge 25. The inwardly facing sealing surface 24 of the bead surface has an axial extent $d_a$ that is in the range 2 mm to 15 mm, preferably in the range 2 mm to 6 mm. FIG. 9 also shows the periphery of a can lid 4, which is conventional in construction, i.e. it may be a can lid that is suitable for use with a can with ring.

Figures 1, 2:
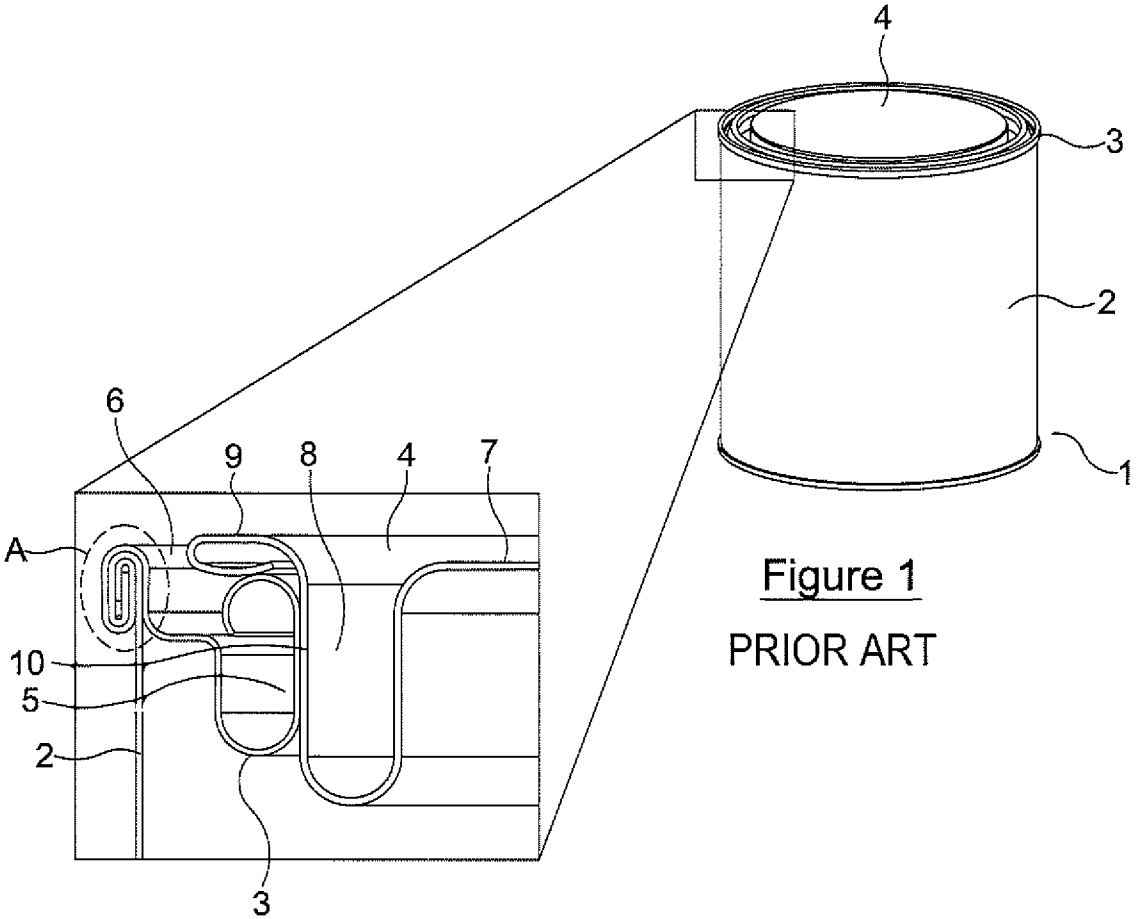
Figure 1 PRIOR ART
Figure 2 PRIOR ART
FIG. 1 illustrates a conventional can utilising a ring, and with a lid attached.
FIG. 2 is an axial cross-sectional detail of the can of FIG. 1.

A comparison of FIGS. 2 and 9 illustrate that the ringless design presented here has a very similar outward appearance to that of the conventional can 1 with ring 3. The ringless can 10 is adapted to receive a lever into a gap 26 between the curled edge 25 of the can body and the curled edge 27 of the lid 4 to enable the lid 4 to be prised off from the can body 10. The drip characteristics of the ringless can 10 are substantially the same as those of the can 1 with ring 3, i.e. paint or other product is captured within the gap 26 before is able to flow over the curled edge 25 of the can body.

Figure 10:
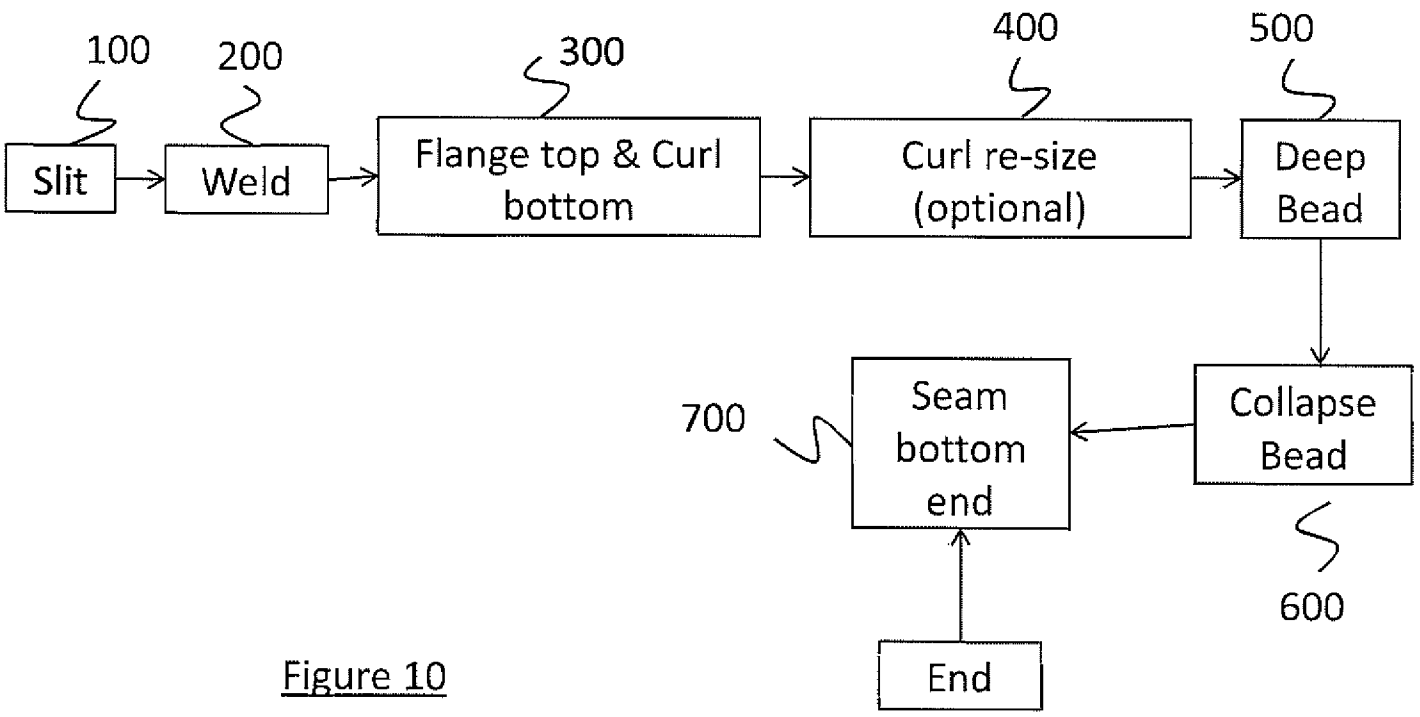
FIG. 10 illustrates a production process for manufacturing the can body of FIG. 9.

FIG. 10 presents an exemplary process for manufacturing a can as described above. Steps 100, 200 and 300 are conventional can body forming steps that take a flat metal sheet and form it into a generally cylindrical can body with a welded seam. The body is formed with a curled top edge and a flange around its bottom edge. Step 400 is an option curl re-sizing operation. Step 500 forms a deep bead around the can body, just beneath the top curled edge (see above and FIGS. 4 and 5). Step 600 collapses the bead in order to pinch the outer periphery and leave a flat sealing surface (see above and FIGS. 7A, 7B and 7C). At step 700 a bottom end is introduced and is seamed to the bottom opening of the can, making use of the previously formed flange.

Figure 11:
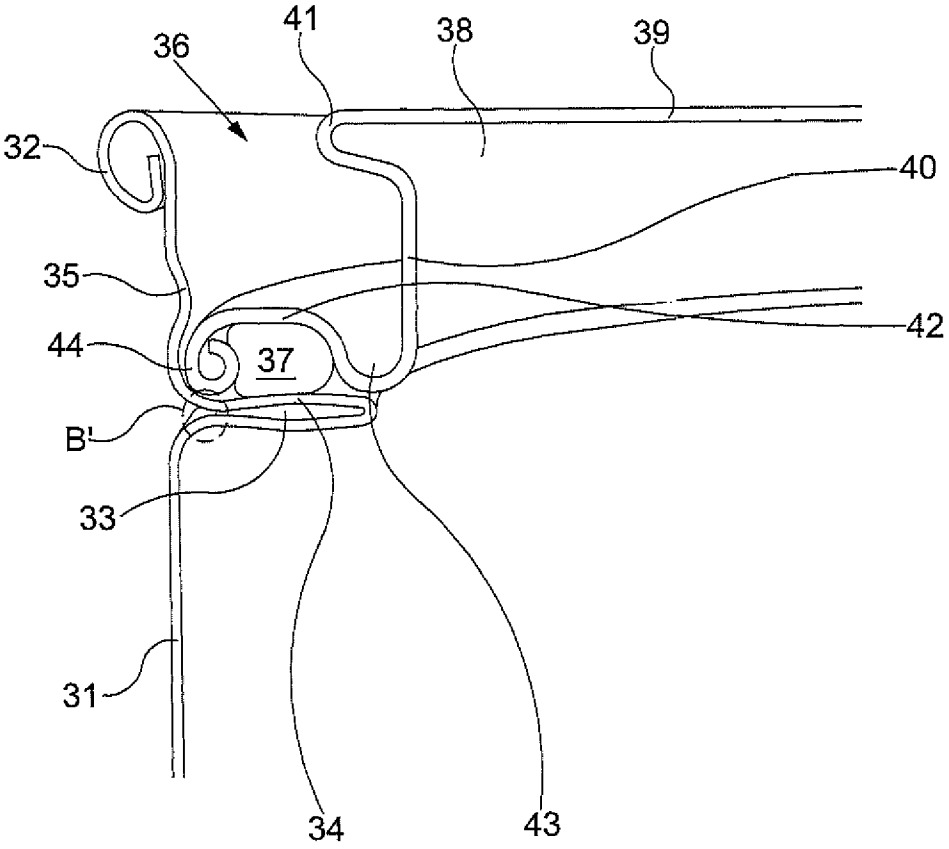
FIG. 11 is an axial cross-sectional detail of a ringless can body with lid attached.

FIG. 11 illustrates a cross-sectional detail of an alternative ringless can design. The can body 31 comprises an inwardly directed flange 33. The flange 33 extends circumferentially around the can body 31 and has an elongate, substantially diamond-shaped or rhomboid cross-section. The flange 33 may formed by first pressing a bead into the wall and then pinching or flattening the bead. The outermost region B' of the flange 33 is effectively closed to an area surrounding the can body 31 thereby substantially preventing the ingress of dirt or other materials into the flange. The flange 33 has an upwardly facing sealing surface 34 which extends into the can body 31 interior, in a plane substantially perpendicular to the longitudinal axis of the can body 31. The upwardly facing sealing surface 34 may comprise two surfaces slightly angled in respect of one another. The sealing surface 34 may form a peak.

The cylindrical can body 31 comprises an outward curl 32 around its top edge. Between the curl 32 and the flange 33, the wall of the can body 31 is provided with a retention bead 35. The retention bead 35 is pressed into the can body 31 and forms a substantially semi-circular, inwardly directed groove around the external circumference of the can body 31. The retention bead 35 opens outwardly onto the area surrounding the can body 31 exterior.

FIG. 11 also illustrates a portion of a substantially rigid can lid 38 in place on the can body 31. The lid 38 comprises a substantially flat centre panel 39 from which a downwardly dependent cylindrical side wall 40 extends. The centre panel 39 has a diameter which exceeds that of the side wall 40, such that the periphery of the centre panel 39 forms a lip 41 which overhangs the side wall 40. The side wall 40 is connected to an outer brim 42 which extends from the side wall 40 in substantially the same plane as the plane of the centre panel 39. An upwardly-opening U-shaped channel 43 runs between the side wall 40 and the brim 42. The brim 42 has an inward curl 44 at its periphery. A layer of sealing compound 37 is provided within the channel formed between the U-shaped channel 43 and the curl 44 such that a downwardly facing sealing surface of the sealing compound 37 is exposed.

In use (i.e. when the lid 38 is in place on the can body 31 and the can body 31 is conventionally oriented), the sealing surface presented by the sealing compound 37 is pressed against the upwardly facing sealing surface 34 presented by the flange 33, slightly compressing the sealing compound. More particularly, the peak of the sealing surface 34 is pressed tightly into the compound 37. It will be appreciated that the compound 37 may project slightly out of the accommodating channel within the brim 42, sit flush with the surface of the channel, or even lie slightly within the channel (due to the upper surface profile of the flange 33).

The lid 38 is retained on the can body 31 by engagement of the lid curl 44 below the retention bead 35. The resilience provided by the lid curl 44 allows the lid 38 to be pressed into the can body 31, past the retention bead 35, in a press or snap fit manner. This structure allows the lid 38 to be reattached to the can body 31 even after initial opening. The spacing between the retention bead 35 and the flange 33 is such that the curled edge 44 is trapped between these two features when the lid 38 is attached to the can body 31.

During transportation of the can, the retention bead 35 helps prevent displacement of the lid 38 from the can body 31 caused by side impact.

The ringless can is adapted to receive a lever into an annular space or gap 36 defined by the cross-sectional shape of the can body 31 and the lid 38. Application of an upward force to the underside of the lip 41 enables the lid 38 to be prised off the can body 31. As the lid 38 is prised off, the seal between the underside of the sealing compound 37 and the upper sealing surface 34 of the flange 33 is broken. The layer of sealing compound 37 is preferably retained on the underside of the brim 42 following opening.

The sealing compound 37 may comprise a plastisol, for example, which may be soft when applied but may subsequently harden. The sealing compound 37 may be applied to the underside of the brim 42 of the lid 38, or to the sealing surface 34 of the can body 31. If the sealing compound 37 is initially applied to the lid 38, the sealing compound 37 may be protected, for example by a removable cover or strip, prior to placement of the lid 38 on the can body 31. This facilitates handling and storage of the lid 38.

Where the can body 31 and lid 38 contain a substance such as paint, for example, a further benefit of the inwardly directed flange 33 is that it may also function as a convenient means of removing excess paint from a brush.

It will be appreciated by the person of skill in the art that modifications may be made to the above described embodiments without departing from the scope of the present invention. For example, whist the pinched bead of the design described above with reference to FIG. 9 presents a flattened inwardly directed sealing surface, the surface may take another form, e.g. curved or sharp edged.

The beads of the ringless cans described herein may not, in some embodiments, be pinched to complete closure, and a gap opening to the exterior of the can body may remain. Whilst the designs described above have a cylindrical can body, other can body shapes may also be contemplated, for example can bodies with a rectangular or triangular cross-section.

The invention claimed is:

1. A can comprising:

a cylindrical can body being formed of only a single homogeneous piece of material that includes a can wall that extends from a base of the can body to a terminal end of the can body the terminal end defining a curled edge that extends radially outwardly from the can wall, said curled edge defining a top opening into the body, the body further comprising an inwardly directed bead pressed into the can wall and extending around the body adjacent to said edge, the bead defining a radially inwardly facing sealing surface which has a substantially constant transverse cross-sectional dimension along an axial extent and has a circular cross-section that extends about a longitudinal axis of the can body wherein said sealing surface of the bead overlaps at least partially with the curled edge in an axial direction, the axial direction being parallel to the longitudinal axis of the can body; and a lid defining an outwardly directed sealing surface abutting the inwardly facing sealing surface presented by the bead in order to seal the lid to the can body, wherein an upwardly facing surface or surfaces of the bead define, together with said edge, an annular trough located radially inside said curled edge, the annular trough having an inclined bottom surface configured to allow access to the lid by a lid removal tool.

2. A can according to claim 1, wherein the radially outermost region of the bead is collapsed in the axial direction to substantially close the bead to an area surrounding the can body.

3. A can according to claim 1, wherein the radially outermost region of the bead is collapsed in the axial direction to substantially close the bead to an area surrounding the can body and the bead has an axial cross-sectional shape that is substantially triangular.

4. A can according to claim 3, wherein said shape is substantially that of an isosceles triangle having a centre line that extends radially and is substantially in axial alignment with the closed region of the bead.

5. A can according to claim 1, wherein the inwardly directed bead has a radial depth ranging from 2 mm to 10 mm.

6. A can according to claim 1, wherein the inwardly directed bead has a radial depth ranging from 2 mm to 5 mm.

7. A can according to claim 1, wherein said sealing surface of the inwardly directed bead has an axial extent of between 2 mm to 10 mm.

8. A can according to claim 1, wherein said sealing surface of the inwardly directed bead has an axial extent of between 2 mm to 6 mm.

9. A can according to claim 1, the can body being metal.

10. A can according to claim 1, wherein the can body and the lid are configured such that, when the lid is sealed to the can body, an upper surface of the lid is located above the edge of the can body.

11. A can according to claim 1 and comprising an end secured to the can body to close a bottom opening of the can body.

12. A can according to claim 1, wherein said lid comprises a substantially flat panel having a U-shaped bead defined around its periphery, a radially outer surface of the bead providing said outwardly directed sealing surface.

13. A can according to claim 12, said lid comprising a curled peripheral edge, a lower surface of that curled edge abutting an upper surface of said inwardly directed bead.

14. A can according to claim 13, wherein the outwardly directed sealing surface is substantially flat and extends from the curled peripheral edge of the lid to a U-shaped surface of the U-shaped bead, the U-shaped surface being spaced radially inward from the outwardly directed sealing surface.

15. A can according to claim 1, wherein said curled edge extends upward in the axial direction from the upwardly facing surface or surfaces of the bead, thereby defining the top opening into the body above an uppermost portion of the bead.

16. A can comprising:

a cylindrical can body being formed of only a single homogeneous piece of material and having an edge defining a top opening into the body, the body further comprising an inwardly directed bead pressed into and extending around the body adjacent to said edge, the bead defining a radially inwardly facing sealing surface which has a substantially constant transverse cross-sectional dimension along an axial extent and has a circular cross-section when viewed axially, wherein the cylindrical can body further comprises a sidewall that extends from the bead to a bottom end of the cylindrical can body, wherein the inwardly facing sealing surface is spaced radially inward from the sidewall such that a diameter of the inwardly facing sealing surface is less than a diameter of the sidewall; and a lid defining an outwardly directed sealing surface abutting the inwardly facing sealing surface presented by the bead in order to seal the lid to the can body, wherein the bead further defines by an upwardly facing surface and a downwardly facing surface that both extend from an outermost region of the bead to the inwardly facing surface, wherein the upwardly facing surface and the downwardly facing surface are substantially symmetric about an axis substantially perpendicular to the sidewall and that extends through the outermost region of the bead.

17. A can according to claim 16, wherein the inwardly facing sealing surface is spaced radially inward from the sidewall by a distance of between 2 mm and 10 mm.

* * * * *